United States Patent [19]

Sando et al.

[11] 4,064,713

[45] Dec. 27, 1977

[54] SEAL DEVICE FOR A HIGH PRESSURE STEAMER

[75] Inventors: Yoshikazu Sando; Hiroshi Ishidoshiro, both of Wakayama, Japan

[73] Assignee: Sando Iron Works Co., Ltd., Japan

[21] Appl. No.: 717,012

[22] Filed: Aug. 23, 1976

[30] Foreign Application Priority Data

| | | |
|---|---|---|
| Sept. 8, 1975 | Japan | 50-123574[U] |
| May 19, 1976 | Japan | 51-57614 |
| May 19, 1976 | Japan | 51-57616 |

[51] Int. Cl.[2] ..... D06B 23/18

[52] U.S. Cl. ..... 68/5 E; 34/242

[58] Field of Search ..... 68/5 E; 34/242

[56] References Cited

U.S. PATENT DOCUMENTS

| | | | |
|---|---|---|---|
| 3,174,230 | 3/1965 | Green et al. | 34/242 X |
| 3,318,115 | 5/1967 | Fujihashi | 68/5 E |
| 3,367,151 | 2/1968 | Fujihashi | 68/5 E |
| 3,651,671 | 3/1972 | Sando et al. | 68/5 E |

*Primary Examiner*—Philip R. Coe

*Attorney, Agent, or Firm*—Toren, McGeady and Stanger

[57] ABSTRACT

A seal device for a high pressure steamer including a pair of rubber seal rolls pressed against each other and mounted on and forming a closure for the opening at one end of an inlet or outlet passage guiding the fabrics to be treated into or out of a high pressure steamer. The device also includes sealing plates disposed in pressed contact against the internal pressure of the steamer with pressure bearing surfaces of the rollsclose to the contacting or nip forming portion of the rolls for blocking the interior of the steamer from its exterior. A cylindrical duct is formed within the passage, with one end of the cylindrical duct communicating with the interior of the steamer while the other end is located close to the contacting portions of the seal rolls. An air port for supplying pressurized air is provided between the cylindrical duct and the passage.

1 Claim, 10 Drawing Figures

SEAL DEVICE FOR A HIGH PRESSURE STEAMER

BACKGROUND OF THE INVENTION

The present invention relates to a seal device for sealing under pressure the inlet or outlet of a high pressure steamer through which fabric to be treated as passed. Textiles, such as cloth or the like, are treated under the conditions of high pressure, high temperature and high humidity in high pressure steamers.

Conventional seal devices of this type are generally composed of a pair of rubber seal rolls extending transversely of the opening to be sealed and disposed in pressed contact with each other. The opening forms an inlet or outlet for fabric to be treated in the drum body of a high pressure steamer. A pair of spaced metal seal rolls are rotatably mounted below the rubber seal rolls and each is disposed in pressed contact with one of the rubber seal rolls for blocking the inlet or the outlet for fabric opening to the drum body.

As the quality of the material to be treated improves the conditions for its treatment at high temperatures and high pressures using such a conventional seal device are required to be such that the internal pressure of the steamer is at more than 5 kg/cm² and the heating temperature is about 160° C, in particular, high pressure and high temperature of more than 155° C are indispensable for dyeing polyester material.

According to the conventional seal device shown in FIG. 1, when the internal pressure within drum body 1 of a high pressure steamer is directed against the pressure bearing surfaces *a, a* occupying nearly one fourth of the peripheral area of the rubber seal rolls 2, 2' and with the conditions, in drum body of the stamer consisting of a pressure of 5 kg/cm², a heating temperature of 158° C and with the full width of each of the rolls 2 and 2' being 2000 mm and 1650 mm, respectively, the load (per ton) imparted respectively on the seal rolls 2, 2' is indicated in the following table:

| Length of roll to be loaded (cm) | Width of rolls 2000 mm | Width of rolls 1650 mm |
|---|---|---|
| Present seal | | |
| (1) 2.5 cm | 25 ton | 20.6 ton |
| (2)13.4 | 13.4 | 11.05 |
| (3) 9.2 | 9.2 | 7.59 |
| (4) 7.2 | 7.2 | 5.94 |
| Lower limit | | |
| (5) 5.8 | 5.8 | 4.78 |
| For reference | | |
| (6) 5.0 | 5.0 | 4.125 |

Consequently, with a seal device recently in use the load of about 20 tons is imparted to each of seal rolls causing widening of the nipping action of the rolls in the event that the width of rolls is 1650 mm and the internal pressure of the drum body of the steamer is 5 kg/cm², wherefore supporting means for the rubber seal rolls having enough strength to bear against the load of about 20 tons should be utilized in the conventional seal device; equipment as set forth about is not effective for enlarging the structure of the seal device.

Further, when the pressure bearing surfaces increase in the peripheral area of the rubber seal rolls, the surface influenced by high temperature generated within the high pressure steamer naturally increases and, as a result, the surface temperature of the seal rolls is raised. Furthermore, when the heating temperature contacting the rubber seal rolls reaches 140° C, the rubber is hardened causing cracks on the surface of the rolls, whereby the sealing effectiveness is reduced by half.

Moreover, dyestuff for fabric and cloth being treated tends to adhere to the peripheral surface of the rubber seal rolls and to permeate into the inner part of the rolls as a result of the heating treatment, thus the rubber rolls are denaturized that is, deprived of their natural qualities, and, as a result, are unable to provide on an efficacious sealing action for a long period of time.

SUMMARY OF THE INVENTION

The present invention is aimed at the elimination of the foregoing drawbacks experienced in conventional seal devices of the prior art and at the provision of an effective seal device for a high pressure steamer.

A seal device according to the present invention can be used on any kind of high pressure steamers having various structures, and an example of an effective seal device in accordance with the present invention, which is applicable to a high pressure steamer equipped with a pair of rubber seal rolls arranged in pressed contact with each other, consists of sealing plates for blocking the interior of the steamer from its exterior. The sealing plates are pressed into contact with the pressure bearing surfaces on the seal rolls, which surfaces are closely adjacent to the portion of the seal rolls in pressed contact, that is, forming the nip. This construction reduces the value of the load as well as the heat imparted to the said rubber rolls by decreasing the area of pressure bearing surfaces on the periphery of each of the rubber seal rolls.

Using such a seal device for a high pressure steamer, the area of pressure bearing surfaces on the periphery of each of the seal rolls can be considerably reduced for obtaining the desired object of the present invention.

Other examples of a seal device embodying the present invention include a pair of rubber seal rolls, pressed into contact with one another, and mounted on the opening from one end of a passage forming an inlet to or outlet from a high pressure steamer in which fabric is treated, sealing plates held in a fixed position and located closely adjacent to the pressed contacting portions of the seal rolls, the sealing plates are arranged to be pressed into contact with pressure bearing surfaces of the seal rolls by the internal pressure of the steamer, which surfaces occupy a part of the circumferential periphery of the rubber seal rolls, and also having the function of blocking the interior of the steamer off from its exterior. Further a cylindrical duct is accommodated within the passage at the inlet or outlet with one end of the duct communicating with the interior of the steamer while the other end is arranged close to the contacting portions of the seal rolls, and a cooling air supply port opens into the space between the outer periphery of the cylindrical duct and the inner peripheral wall of the passage for cooling the seal rolls by directing cooling air into the space formed between the duct and the passage.

The seal device having the aforementioned structure is capable of constantly cooling the rubber seal rolls to maintain their material characteristics, such characteristics are depleted when the rubber rolls are heated in a conventional seal device of the prior art. The seal device of the present invention has the further advantage of extending the service life of the rubber seal rolls and of maintaining an effective sealing action over an extended period of time.

As a modification, a port for directing pressurized air between the outer periphery of the cylindrical duct and the inner peripheral wall of the passage may substitute for a cooling air supply port provided in the other example.

In the structure of the above mentioned modification, pressurized air fed through the air supply port flows rapidly toward the contacting surface portions of the seal rolls along the outer periphery of the cylindrical duct whereby the sealing plates are pressed into contact with the seal rolls due to the pressure of the air flow which is then reversed and flows through the inner part of the cylindrical duct against the internal pressure of the steamer for effectively maintaining the sealing action for the internal pressure of the steamer.

BRIEF DESCRIPTION OF THE DRAWINGS

Identical reference numerals in FIGS. 5 – 10 are used for the corresponding parts in said figures.

DESCRIPTION OF THE PREFERRED EMBODIMENTS

A seal device according to the present invention to be mounted on a high pressure steamer will now be explained in detail with reference to the accompanying drawings by way of example in one embodiment of the invention.

EXAMPLE I

Figure 3:
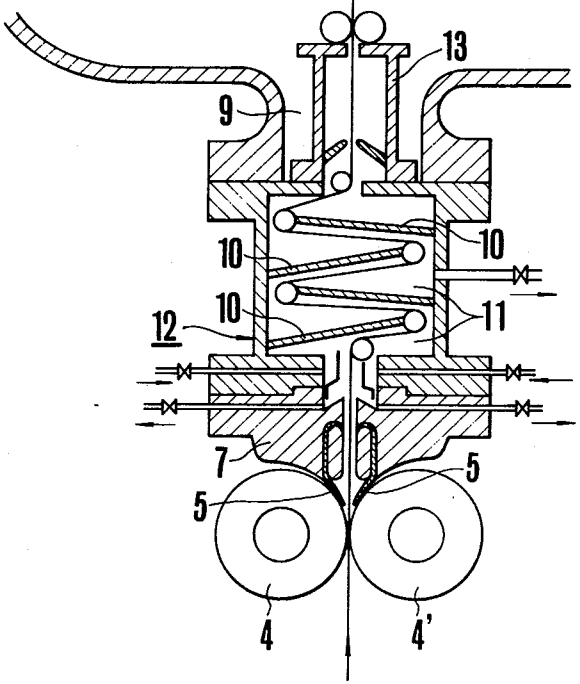
FIG. 3 is a sectional view of the seal device illustrated in FIG. 2 showing the seal device fixed on an opening port of a steamer.
Figure 1:
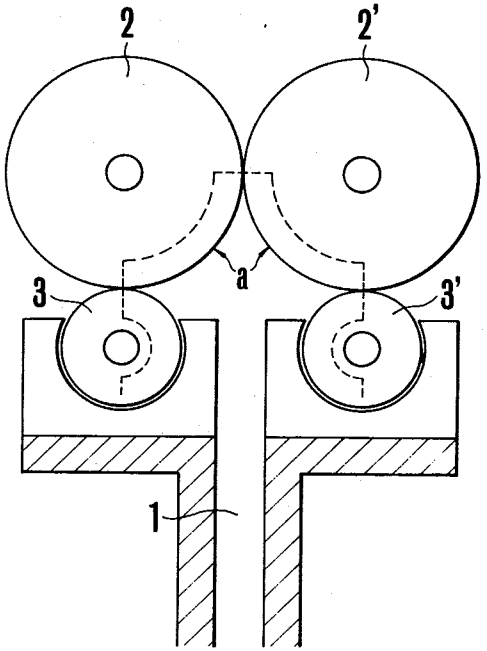
FIG.1 PRIOR ART
FIG. 1 is a schematic view partly in section of a conventional prior art seal device.
Figure 2:
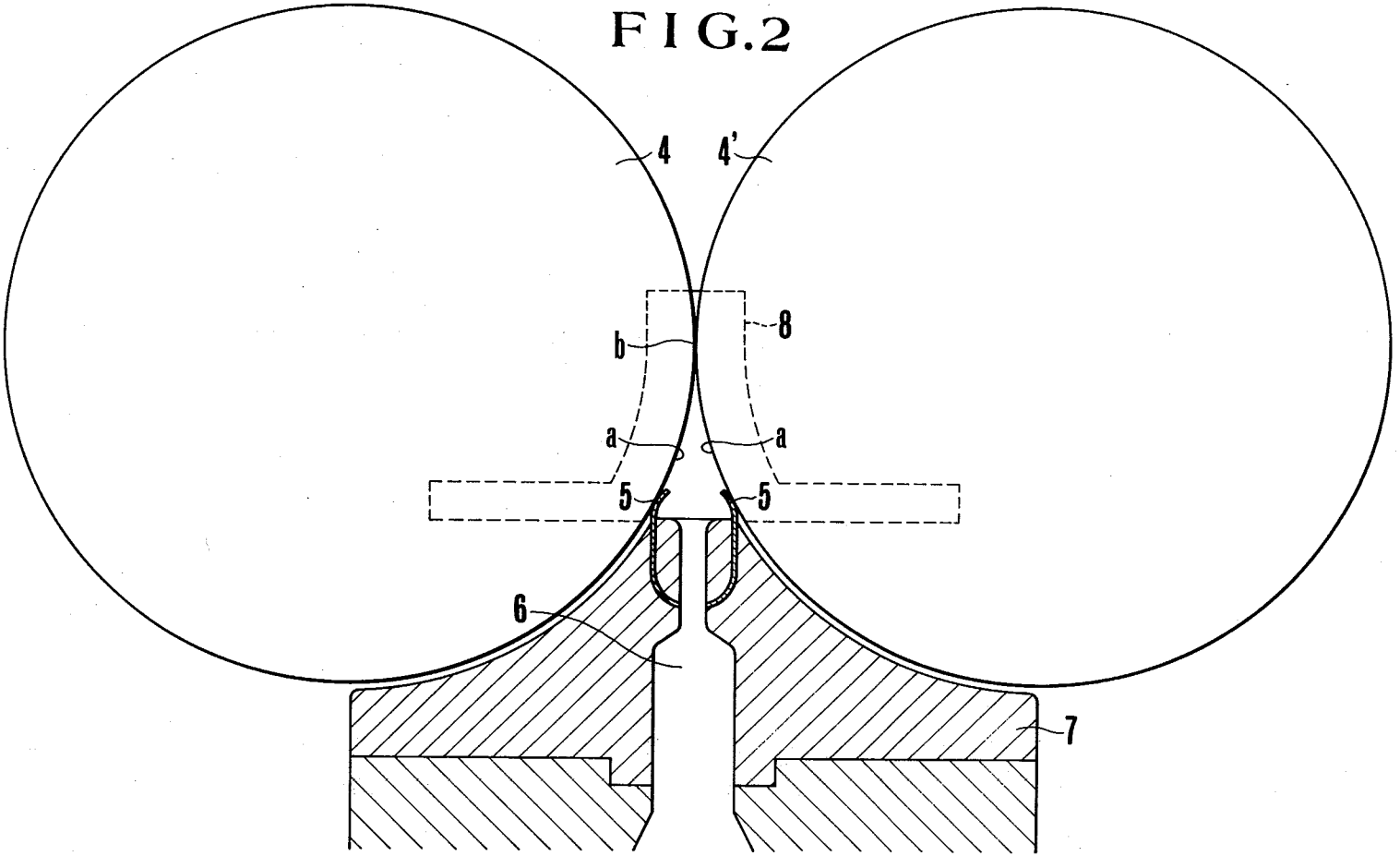
FIG. 2 is a side view of a seal device embodying the present invention and showing the arrangement of a pair of rubber seal rolls and sealing plates in pressed contact with each of the rubber rolls.

Sealing plates 5 made of plastic material such as teflon having a little flexibility are arranged in pressing contact with each of pressure bearing surfaces *a, a* on rubber seal rolls 4, 4', which surfaces are adjacent to the contacting portions *b* of the seal rolls 4 and 4' which are in pressed against one another note FIGS. 2 and 3. The sealing plates 5 are fixed to and supported by oppositely arranged frames 7 which form a passage 6 therebetween for fabric to be treated. The plates 5 are positioned to avoid blocking the passage 6. Sealing plates 8 are pressed against and attached to each end surface of the seal rolls 4, 4'.

This seal device is secured to an opening port 9 in the drum body of a high pressure steamer through a decompression mechanism 12 comprising a decompression chamber 11 containing a number of oppositely arranged and spaced interference plates 10 forming a zigzag path as shown in FIG. 3. Another decompression chamber is disposed inside of the opening port 9.

Figure 4:
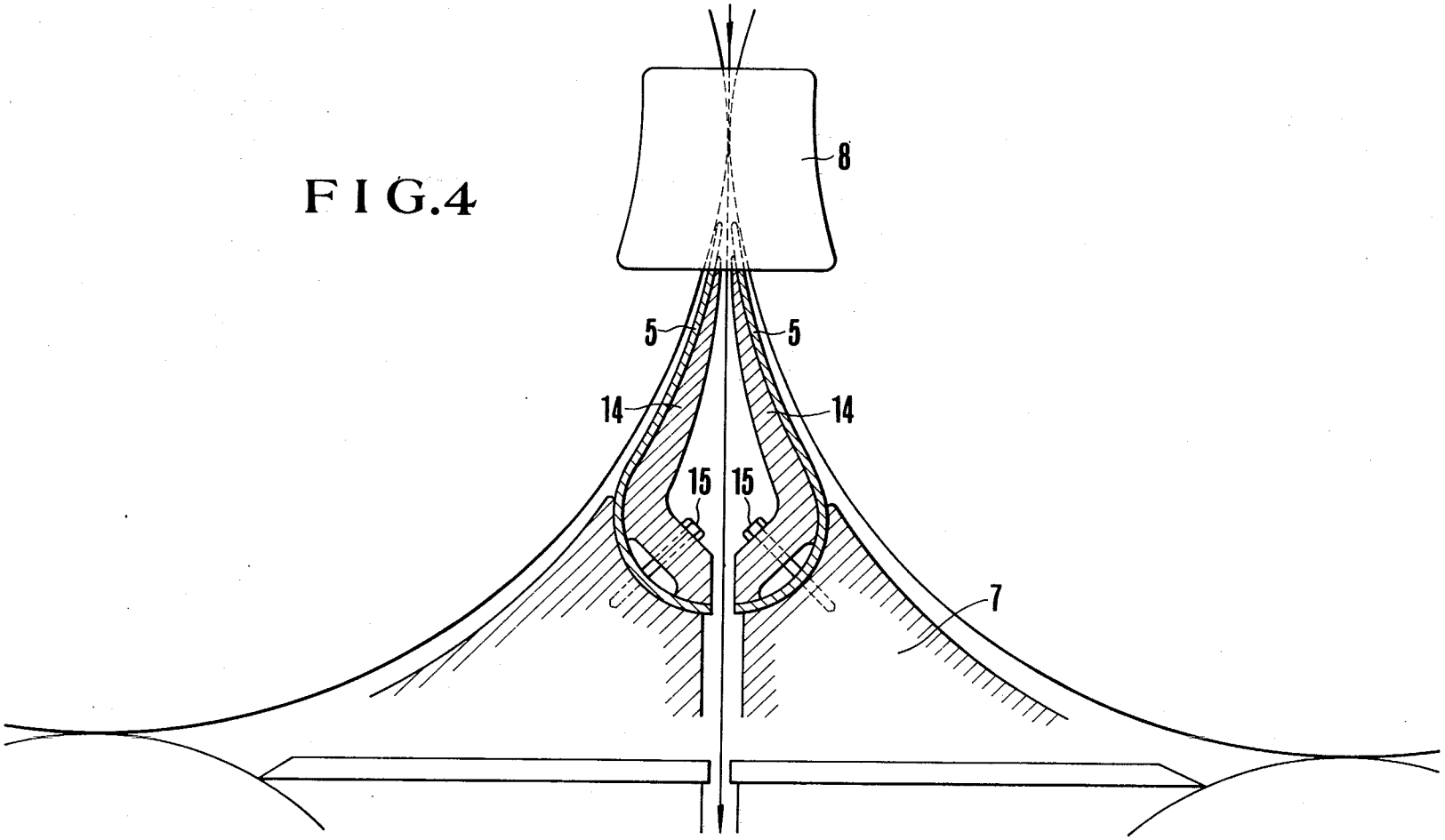
FIG. 4 is a sectional view of the seal device showing a modification of the foregoing embodiment.

The modified embodiment shown in FIG. 4 is constructed with rubber seal rolls 8 forming narrower pressure bearing surfaces, and with sealing plates 55 made of flexible plastic sheet, such as teflon sheet, euron sheet or a metal sheet, and fixed to frames 7 by means of adapter plates 14 and bolts 15.

Due to the above mentioned structure, the area the pressure bearing surfaces forming a part of periphery of each of the seal rolls is extremely narrowed to reduce the value of load imparted to the seal rolls and to decrease the heat conducted from the interior of a steamer to avoid damage of the seal rolls resulting from heating thereof. Together with the advantage of the seal device in a form of the above mentioned embodiment, the means for supporting the seal rubber rolls can be made lighter in weight as well as simplified in structure, moreover, it has the great advantage of enhanced durability. The seal device of the present invention, employed in combination with a decompression mechanism as described above affords a remarkable sealing effect.

EXAMPLE II

Figure 5:
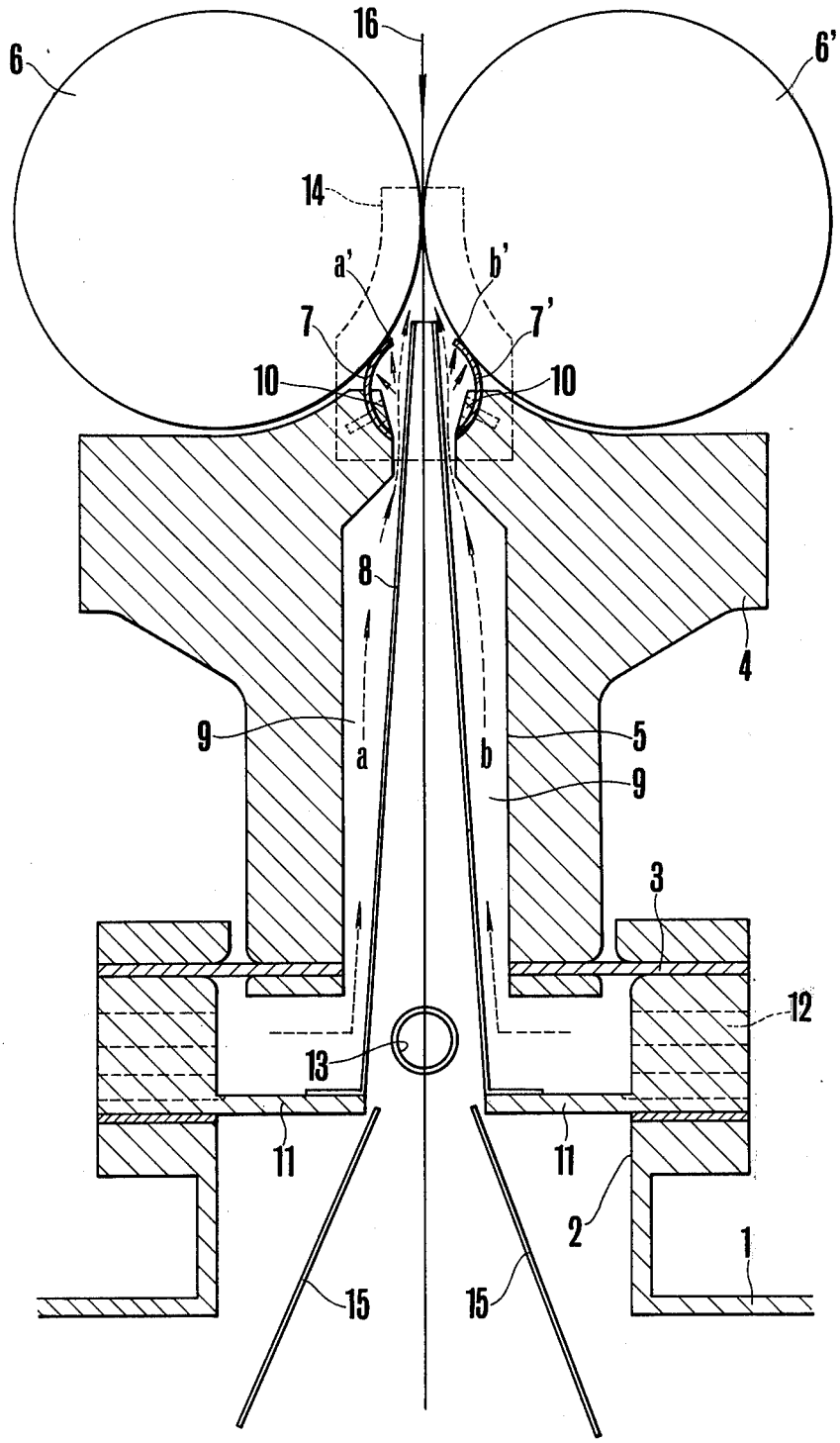
FIG. 5 is a sectional view of the seal device of the present invention illustrating another embodiment provided with a means for cooling the rubber seal rolls.

In FIG. 5, sealing blocks 4 are supported on an inlet 2 for fabric to be treated in the drum body 1 of a high pressure steamer. Seal packings 3 are positioned between the blocks 4 and drum body 1. The blocks 4 form a passage 5 for the fabric to be treated. A pair of rubber seal rolls 6, 6' in pressed contact with each other are rotatably mounted on the upper sides of the seal blocks 4 which form the passage 5. The paired seal rolls 6, 6' are rotatably mounted on the upper sides of said seal blocks 4 for blocking the opening provided at the upper end of the passage 5. A pair of resilient curved sealing plates 7, 7' are fixed at their lower ends by clamping plates 10 to shoulders in the upper opening provided by the passage 5 formed between the seal blocks 4, while the upper parts of the seal plates 7 and 7' are disposed in resilient and forced attachment to the seal rolls 6 and 6'. Quality of the material for making the sealing plates 7, 7' is not specially defined, however, in the above mentioned embodiment, stainless steel sheet is used. A cylindrical duct 8 is fixed within the passage 5 and fabric to be treated passes through the inside of the cylindrical duct 8. Moreover, an air canal 9 for flowing pressurized air therethrough is formed between the outer periphery of the cylindrical duct 8 and the inner peripheral wall forming the passage 5. The cylindrical duct 8 is fixed at its lower end to protruding flanges 11 on the inner wall of the inlet 2 for fabric to be treated.

A supply port 12 cooling air into said air canal 9; and exhaust port 13 for decompressed air is provided at the lower part of the cylindrical duct 8; end surface sealing plates 14 are attached to the end surfaces of both the seal rolls 6 and 6' and the sealing plates 7 and 7' respectively; and a drain check plate 15 extends downwardly below the lower end of the duct 8.

The following is an explanation of the operation of the above mentioned embodiment constructed.

When fabric 16 to be treated is introduced into the drum body 1 of a high pressure steamer through the pressed contacting portions of the rubber seal rolls and the interior of the cylindrical duct 8, cooling air having a pressure higher than the internal pressure of the drum body of a steamer, is blown into the air canal 9 from supply port 12, and the pressure of the cooling air is imparted to the inner surfaces of the sealing plates 7, 7' and the sealing plates 7, 7' are forced against the seal rolls, furthermore, the cooling air having cooled the sealing plates 7, 7' is flow over the the upper surfaces of the seal rolls 6, 6' for cooling them.

As indicated above, after the air cools the sealing plates 7, 7' and the seal rubber rolls 6, 6', it flows in the downwardly direction indicated by arrows *a, a'* from the upper end of the cylindrical duct 8 against the internal pressure within the drum body 1 of the stamer, so that the internal pressure of the drum body is blocked from flowing upwardly in the cylindrical duct and cannot leak out through the clearance formed between seal rolls, thus complete sealing can be successfully effective.

According to the seal device described in the above mentioned embodiment, the rubber seal rolls are cooled by a flowing stream of pressurized air directed through the cooling air supply port 12, whereby the seal device of the present invention has the great advantage of avoiding the denaturation of the rubber seal rolls as well as enhancing their durability, thus an effective sealing action can be provided over an extended period of time.

Further, in the foregoing embodiment, a part of the pressurized air directed against the sealing plates 7, 7' for forcing them against the seal rolls 6, 6' is adapted to exert respectively, on clearances *a'* and *b'* formed between the sealing plates 7, 7' and the seal rolls 6, 6' for moderating to a small extent the contacting force generated between sealing plates and seal rolls so that a favourable effect on the smooth rotation of the seal rolls can be obtained.

Application of the seal device disclosed in Example II to any high pressure steamers of various structures will be explained hereinafter. For the sake of convenience in the explanation, the whole structure of the seal device disclosed in Example II is represented by the symbol (A) in FIG. 6.

EXAMPLE III

Figure 6:
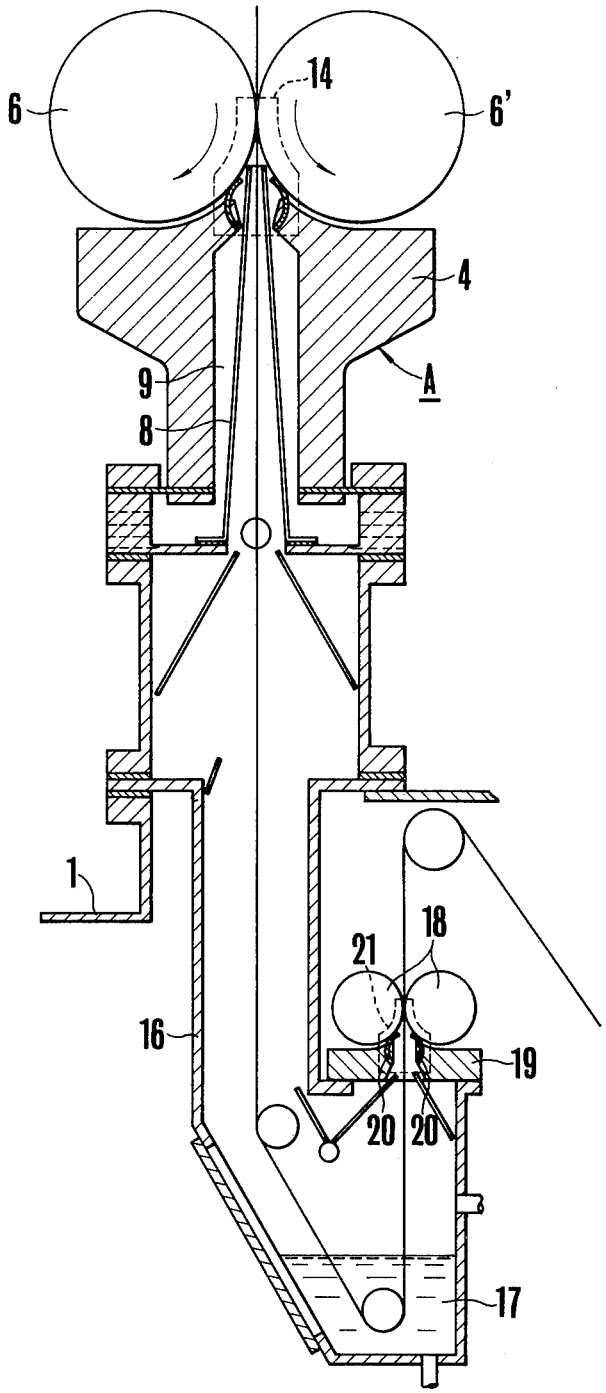
FIG. 6 is a sectional view of still another embodiment of the seal device of the present invention based on the structure of the embodiment shown in FIG. 5, with the device mounted on a high pressure steamer.

The embodiment shown in FIG. 6 comprises a cylindrical passage for transferring fabric to be treated which has a vertical sectional profile in the general shape of the character J and is located within the drum body 1 of a steamer. The passage extends downwardly from the lower end of the seal device 4, to a liquid reservoir 17 provided on the lower part of the cylindrical passage 16, and then upwardly to a pair of clearance rolls 18 located at an opening to the passage 16 and the rolls having 0.2 to 2 mm clearance between them for admitting only fabric to be treated to pass therethrough. A sealing plate 20 which is forced against each of the clearance rolls 18 and is interposed between the clearance roll 18 and a frame 19. A end surface sealing plates 21 is forced against each of the end surfaces of clearance rolls 18 and the sealing plates 20.

According to this embodiment constructed as set forth above, it is difficult to exert the internal pressure of the drum body 1 on the inner part of the cylindrical passage 16 because of the interfering action of the clearance rolls, the sealing plates and the end surface sealing plates, so that the internal pressure of the cylindrical passage is reduced below the internal pressure of the drum body of the steamer, wherefore the sealing effect of the seal device (A) is improved remarkably.

EXAMPLE IV

Figure 7:
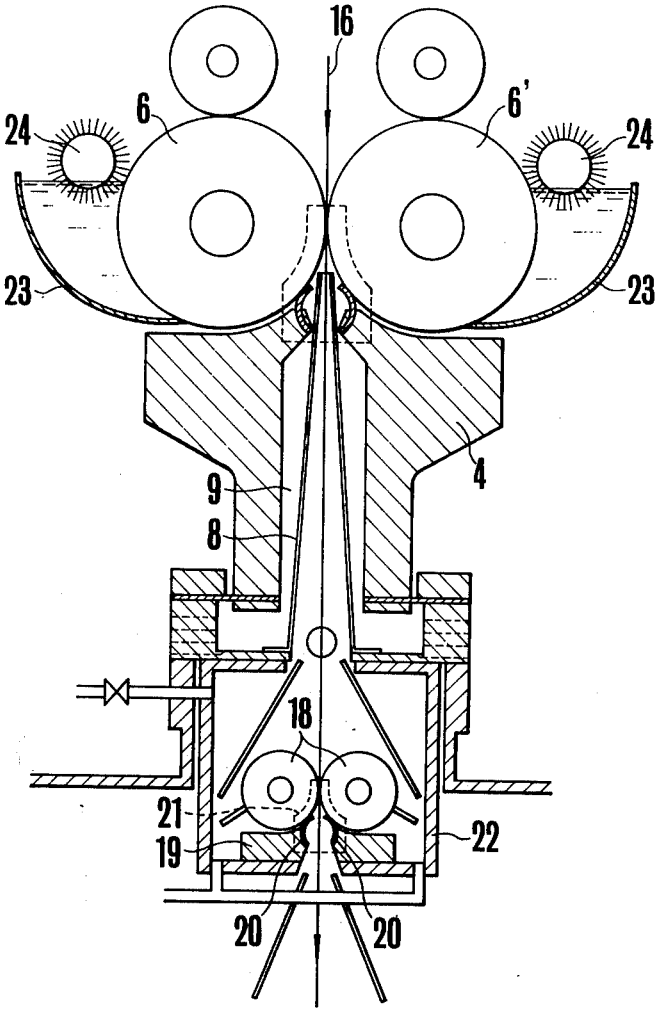
FIG. 7 is a sectional view of yet another embodiment of the present invention.

The embodiment shown in FIG. 7 is equipped with a square box 22 substituting for the fabric transferring cylindrical passage 16 having the sectional profile in a form of the character J provided in the above Example III. The square box 22 contains a seal embodiment described composed composed of a pair of clearance rolls 18, sealing plates 20 and end surface sealing plates 21 in just the same way as in the mechanism in Example III. Further water tank frames 23 are symmetrically provided adjacent to the rubber seal rolls 6, 6' so that each of the rolls is washed and cleaned as well as being cooled by brush rollers 24 provided above the water tank frames 23.

EXAMPLE V

Figure 8:
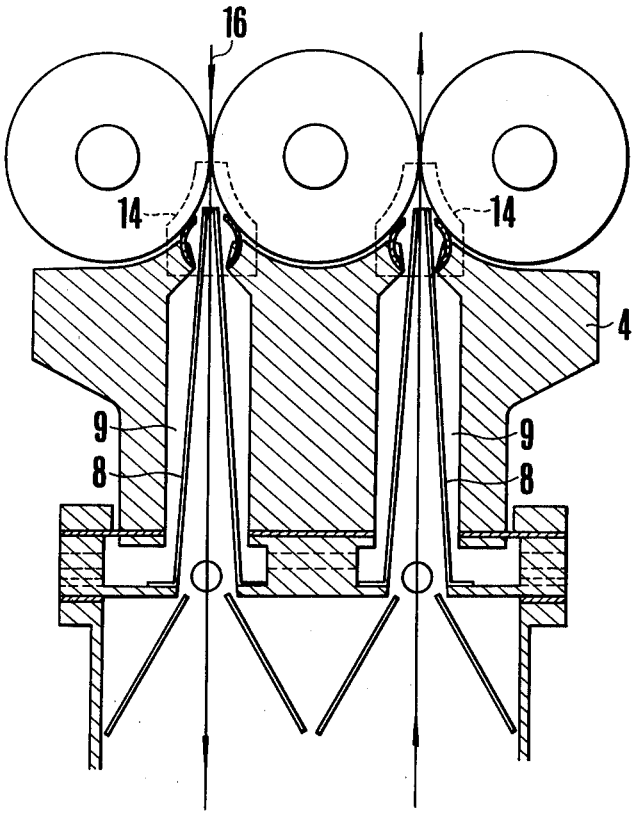
FIG. 8 is a sectional view of a modification of the seal device shown in FIG. 5.

The embodiment shown in FIG. 8 is constructed with two seal devices A and A mounted in laterally contacting arrangement at the inlet and the outlet of fabric to be treated, so that one rubber seal roll serves in both of the seal devices A for simplifying the combined structure of the two seal devices by eliminating one of the seal rolls.

EXAMPLE VI

Figure 9:
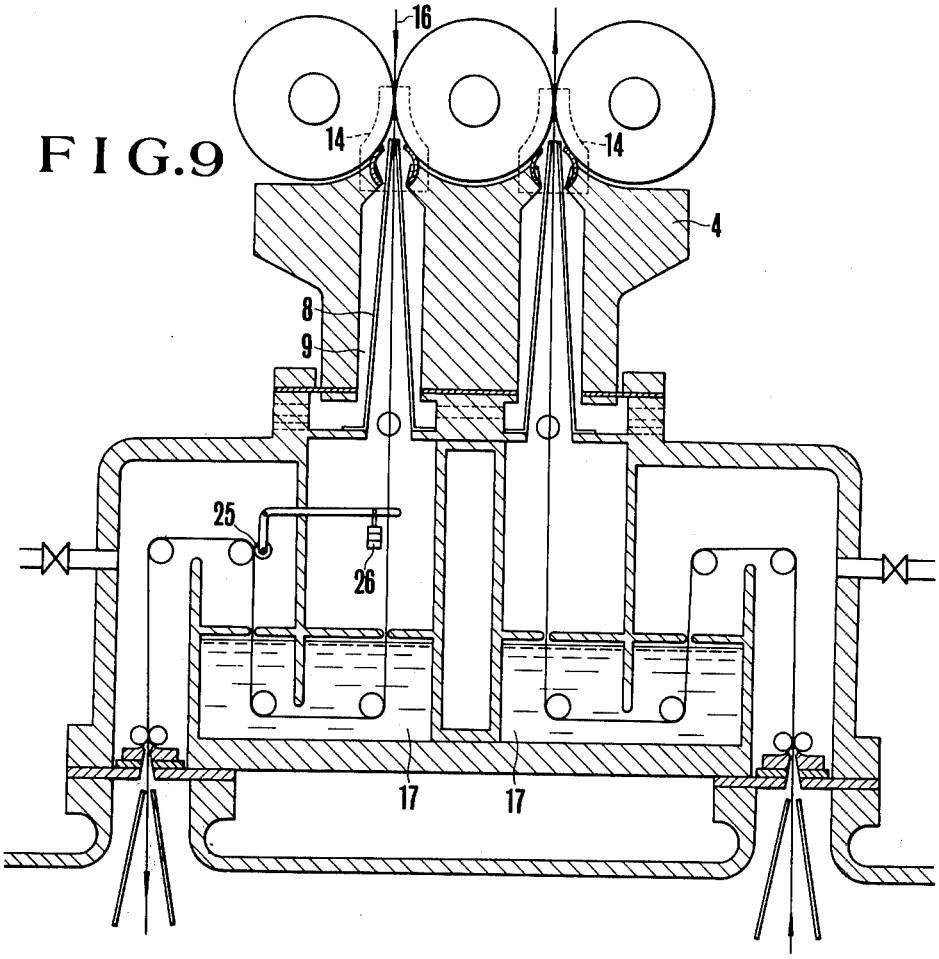
FIG. 9 is a sectional view of the modification shown in FIG. 8 mounted on a high pressure steamer having a structure different from that of the steamer shown in FIG. 6.

The embodiment shown in FIG. 9 is constructed based on the identical idea of simplifying the combined structure in laterally contacting arrangement of the devices mounted at the inlet and the outlet for the fabric as described in Example III by utilizing one of rubber seal rolls in both of the seal devices thereby eliminating one seal roll. The seal devices are different to some extent in shape from the one shown in FIG. 6, but the structural function and effect are the same.

In Example VI, a compression roller 25 is provided within the seal device mounted in the inlet of the fabric for squeezing liquid out of fabric impregnated in a liquid reservoir installed in the seal device for constantly keeping the quantity of liquid contained within fabric treated. A weight 26 regulates the pressure of the compression roller.

EXAMPLE VII

Figure 10:
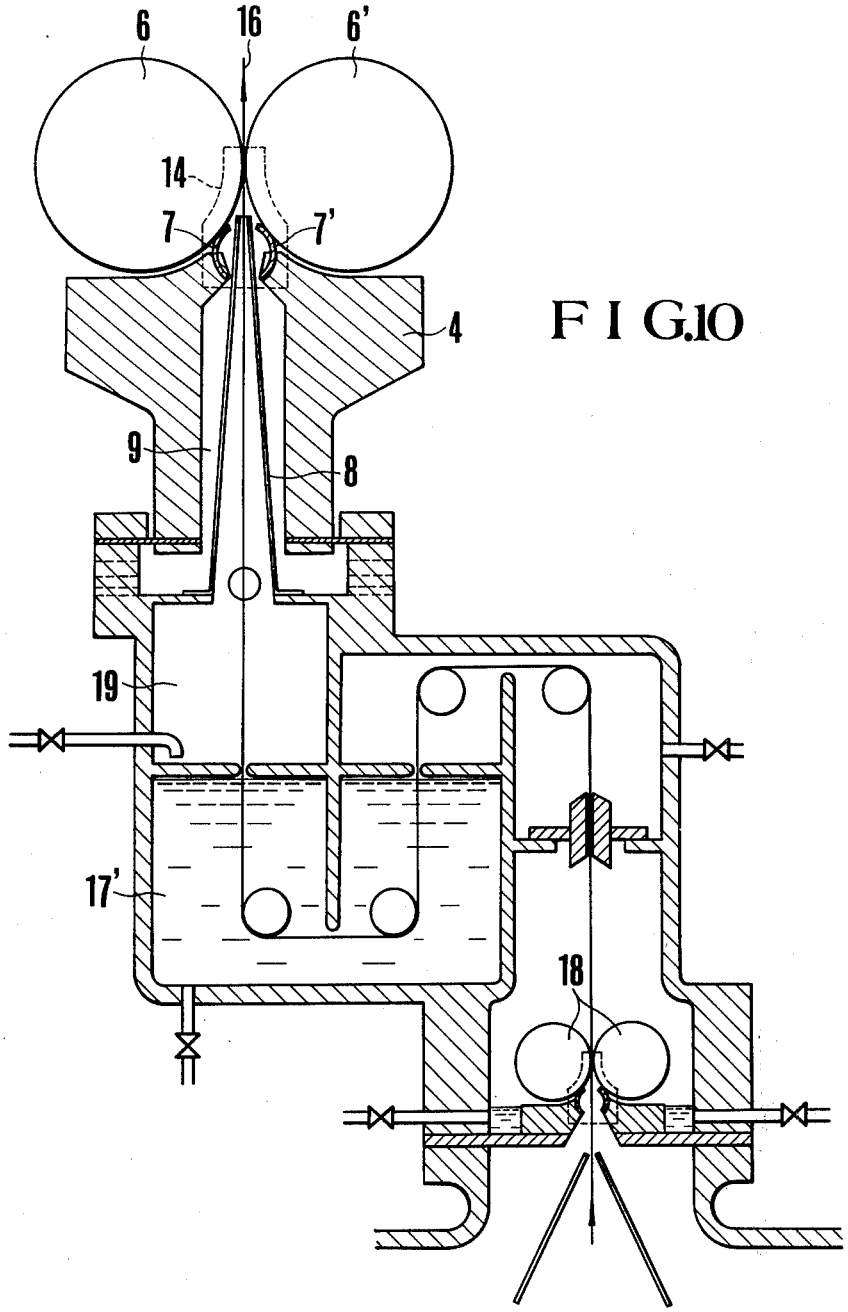
FIG. 10 is a sectional view of a modified application of the embodiment shown in FIG. 5 to a high pressure steamer from the one shown in FIG. 9.

The embodiment shown in FIG. 10 has nearly the same structure as that of the foregoing Example III shown in FIG. 6 excluding the difference in shape and the location of a liquid reservoir. In liquid reservoir 17' in FIG. 10 a part of the fabric transferring passge 16 intermediately located between the seal rolls 6, 6' and the clearance rolls 18 is bent in to a U-shape the U-shape portion of the cylindrical passage is utilized as a liquid reservoir, thus affording a better sealing effect due to the liquid pressure accumulated in the liquid reservoir 17'.

Other parts of the structure excluding the above mentioned elements in this embodiment are similar to those described in Example III, accordingly further description is unnecessary.

The seal device A according to the present invention is applicable to any high pressure steamers constructed of various structures, and also can be used in combination with decompression mechanism other than those shown in the foregoing several embodiments.

What is claimed is:

1. A seal device for a high pressure steamer comprising a seal block forming an axially elongated passage and arranged to be mounted on one of the inlet to or outlet from the drum body of a high pressure steamer, said passage having a first end opening to the drum body and second end spaced outwardly from the drum body, a pair of rubber seal rolls located at the second end of said passage and disposed in pressed contact with one another forming a nip therebetween, said rolls forming a closure for the opening from the second end of said passage, sealing plates located at the second end of said passage and fixed to said seal block, said sealing plate projecting outwardly from said seal block and arranged to contact the peripheral surfaces of said seal rolls, a cylindrical duct located within and extending in the axial direction of said passage and being spaced inwardly from the surface of the passage forming therebetween an annular flow space extending in the axial direction of said passage and cylindrical duct, said cylindrical duct having a first end close to the first end of said passage and a second end located at the second end of said passage adjacent the nip formed by said seal rolls, said annular flow space being closed at the end thereof located at the first end of said cylindrical duct, and a port for supplying pressurized air located in said seal block for supplying pressurized air into said annular flow space for flowing the pressurized air through the flow space to the second end of said cylindrical duct adjacent said seal rolls where the air contacts said sealing plates and the peripheral surface of said seal rolls and reverses direction and flows through said cylindrical duct toward the first end thereof, said sealing plates being flexible so that the pressurized air contacting said plates forces them into contact with the peripheral surface of said seal rolls.

* * * * *